United States Patent [19]

Ladusaw

[11] Patent Number: 4,474,030

[45] Date of Patent: Oct. 2, 1984

[54] REVERSIBLE REFRIGERANT HEAT PUMP SYSTEM

[75] Inventor: William T. Ladusaw, Louisville, Ky.

[73] Assignee: General Electric Company, Louisville, Ky.

[21] Appl. No.: 526,541

[22] Filed: Aug. 25, 1983

[51] Int. Cl.[3] ..... F25B 13/00

[52] U.S. Cl. ..... 62/324.1

[58] Field of Search ..... 62/324.1

[56] References Cited

U.S. PATENT DOCUMENTS 2,979,917 4/1961 Meagher ..... 62/196

3,302,424 2/1967 Scherzinger ..... 62/296

4,094,165 6/1978 Sisk ..... 62/115

4,367,638 1/1983 Gray ..... 62/324.6

*Primary Examiner*—Lloyd L. King

*Attorney, Agent, or Firm*—Frank P. Giacalone; Radford M. Reams

[57] ABSTRACT

A reversible refrigerant heat pump system wherein a pair of volumes are provided, each being adapted to function alternatively as an oil separator when in the flow path of high pressure discharge refrigerant gas from the compressor and as an accumulator when in the flow path of low pressure suction refrigerant gas returning to the compressor.

11 Claims, 2 Drawing Figures

REVERSIBLE REFRIGERANT HEAT PUMP SYSTEM

BACKGROUND OF INVENTION

This invention relates to a reversible refrigerant heat pump system wherein a pair of volumes are provided to function alternatively as a muffler oil separator when in the path of high pressure discharge refrigerant gas and as an accumulator liquid refrigerant separator when in the path of low pressure suction refrigerant gas.

In some conventional reversible refrigerant heat pump systems, a suction accumulator is provided in the suction line between the compressor and the reversing valve. In this arrangement, the accumulator is permanently arranged in the suction line between the compressor suction inlet and the system reversing valve. This provides a volume that functions as an accumulator in both the heating and cooling cycle; however, it does not provide for oil separation and muffling in the high pressure discharge side of the system. The gaseous refrigerant discharged from the compressor contains lubricating oil dispersed therein in the form of fine particles. The oil, together with the gaseous refrigerant, is fed to the refrigeration system heat exchangers. Some of this oil will remain in the system, causing a reduction in heat transfer rate of the heat exchangers and in some situations may result in the volume of oil in the compressor oil sump to be inadequate to effectively lubricate the compressor bearings. To prevent this, means must be provided for separating entrained oil from the discharged refrigerant gas before it travels to the system heat exchangers in a manner that allows the entrained oil to be returned to the compressor oil sump.

SUMMARY OF THE INVENTION

An object of the present invention is to provide a reversible refrigerant heat pump system which is operable in a heating and cooling cycle with a pair of volumes that are interconnected so as to alternatively function as a suction accumulator during one cycle of operation and as a discharge oil separator/muffler in the other cycle of operation.

This invention relates to a reversible refrigerant heat pump system including an indoor heat exchanger and an outdoor heat exchanger interconnected at one end by a flow control capillary, dividing the system between a high pressure side and a low pressure side. The motor driven compressor is arranged in a hermetic casing which includes an oil sump area. The system is placed in a heating or cooling mode by a fluid reversal means which includes a first and second reverse flow ports for selectively connecting the compressor to the other end of the indoor and outdoor heat exchangers through first and second conduits, respectively.

A volume is connected in each of the first and second conduits with each of the volumes adapted to function as a suction accumulator to receive low pressure refrigerant gas returning to the compressor when its associated heat exchanger on the low pressure side of the system functions as an evaporator or alternatively to function as an oil separator to receive high pressure refrigerant gas from the compressor when its associated heat exchanger functions as a condenser.

More particularly, each of the volumes includes a housing having top and bottom walls. The conduit end connected to the fluid reversal means includes a vertical portion which extends through the bottom wall of the housing and terminates with its open end adjacent the top wall. The vertical portion so positioned in the housing is provided with an opening adjacent the bottom wall that is dimensioned for metering liquid refrigerant to the compressor when the volume is functioning as the system accumulator in the suction gas flow path. Positioned in the upper portion of each volume between the top wall and the open end of the vertical portion is a screen which when the volume is functioning as the system oil separator is in the discharge gas flow path allows high pressure refrigerant gas from the compressor to pass therethrough while causing the oil to impinge thereon and separate to be transmitted to the lower portion of the housing. The lower portion of the housing is connected to the oil sump by a conduit which includes a pressure sensitive valve that allows oil separated from the high pressure gaseous refrigerant to return to the compressor oil sump when the volume is functioning as the system oil separator and is at substantially the same relatively high pressure as the compressor.

DESCRIPTION OF THE PREFERRED EMBODIMENT

Figure 1:
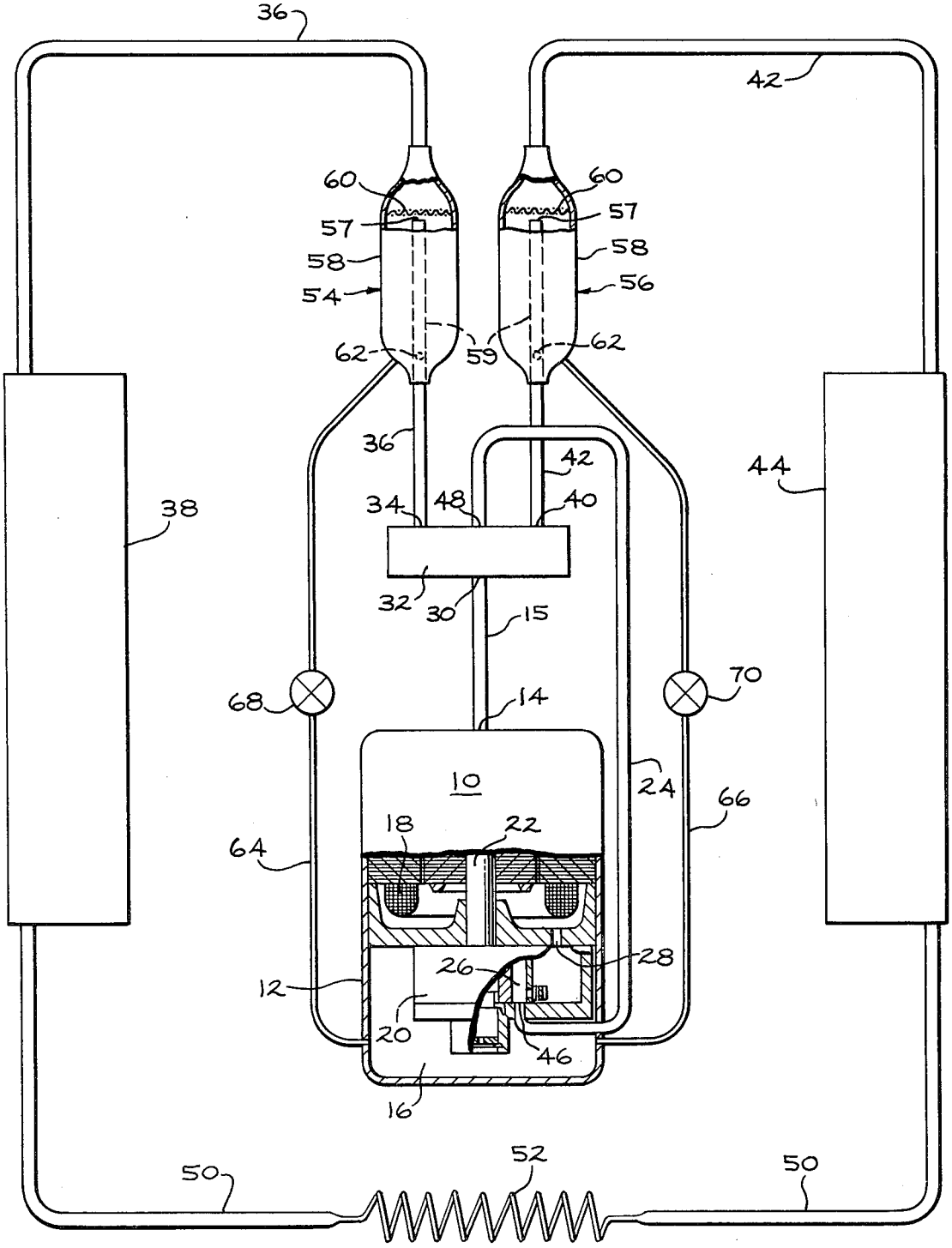
FIG. 1 is a schematic view of the reversible heat pump refrigeration system including the present invention.

Referring now to the embodiment of FIG. 1 of the drawing, there is shown schematically a conventional reversible cycle heat pump refrigeration system. The system includes a rotary compressor 10 having a casing 12 including a high pressure discharge opening 14 in the upper portion of the casing connected to the system discharge line 15 and an oil sump area 16 in the lower portion thereof. Positioned in casing 12 is a motor 18 for driving a rotary compressor unit 20 through a shaft 22. The system suction line 24 is connected so as to deliver low pressure gas to the compressor cylinder 26 where it is compressed and discharged into the casing 12 through a discharge port 28. The high pressure gas discharge opening 14 is connected by the conduit 15 to the intake port 30 of a reversing valve 32. The port 30 is selectively connected during the cooling cycle to one reverse flow port 34 of valve 32 which through a conduit 36 directs high pressure hot gaseous refrigerant to a heat exchanger 38 to cause it to function as the system condenser. Heat exchanger 38 is preferably located or arranged so that it is subjected to outdoor air and is hereinafter referred to as the "outdoor coil." The port 30 is selectively connected during the heating cycle to a second reverse flow port 40 of the valve 32 which through a conduit 42 directs hot gaseous refrigerant to a heat exchanger 44 to cause it to function as the system condenser. Heat exchanger 44 is disposed so that it is subjected to recirculated indoor air and is hereafter referred to as the "indoor coil."

The low pressure intake or suction port 46 of the compressor unit 20 is connected by the suction conduit 24 to the exhaust port 48 of the valve 32, which port is selectively connected with either of the reverse flow ports 34 and 40 in the heating and cooling cycle respectively. In the cooling position, the valve 32 is arranged so that the high pressure discharge gas from conduit 15 is directed through port 34 and conduit 36 to the outdoor heat exchanger 38 which in the cooling cycle is used as the condenser. The suction or intake low pressure gas returning to the compressor from heat exchanger 44, which is being used as the evaporator during the cooling cycle, is through conduit 42, reverse flow port 40, suction line 24, and back to the compressor unit 20. To complete the closed refrigeration circuit, the heat exchangers 38 and 44 are interconnected by a conduit or liquid line 50 which includes a flow control means 52 in the form of a capillary that divides the system between a high pressure side and a low pressure side.

By the present invention, the reversible flow heat pump system is provided with a suction accumulator and discharge oil separator/muffler system that is effective in both the heating and cooling cycles of operation.

To this end a first volume 54 is connected into the system in conduit 36 between the outdoor heat exchanger 38 and the first reverse flow port 34, and a second volume 56 is connected into the system in conduit 42 between the indoor heat exchanger 44 and the second reverse flow port 40. As will be explained fully hereinafter, in the cooling cycle the primary purpose of the volume 56, which is now on the low side of the system and functions as the system suction accumulator, is to separate any liquid refrigerant from the gaseous refrigerant and to meter liquid refrigerant to the compressor through the suction line 24 at a controlled rate such as to prevent damage to the compressor components. At the same time in the cooling cycle the volume 54, which is now on the high side of the system, functions as the discharge oil separator and system muffler. In the heating cycle, the reverse is true; the volume 56 functions as the discharge oil separator/muffler and volume 54 function as the system suction accumulator.

The volumes 54 and 56 are identical and accordingly the similar parts are identified by the same reference numbers. Each of the volumes comprises a vertically extending, cylindrical casing or housing 58 tapering at the upper and lower ends to form top and bottom walls. The one end of the conduits 36 and 42 extending from the reverse flow ports 34 and 40, respectively, extend through an opening in the bottom wall of the housing 58 and form a vertical standpipe end 59 with its open outlet end 57 positioned adjacent the top wall. The other end of the conduits 36 and 42 extending from the heat exchangers 38, 44 are connected to the upper walls of the volumes 54, 56, respectively. Each of the housings 58 also includes a screen member 60 extending across the cross section of the housing 58. The screen member 60 is positioned to, in effect, divide the interior of the housing between the outlet end 57 of standpipe 59 and the outlet of conduits 36 and 42 entering the upper wall of the housing. Refrigerant suction gas returning to the compressor may include some liquid refrigerant which can, depending on the amount, cause compressor damage, accordingly means are provided for metering liquid refrigerant to the compressor. To this end at least one metering hole 62 is provided in the standpipe 59 for gradually returning liquid to the compressor through the suction line 24 when the volume is functioning as the system suction accumulator.

In the cooling cycle, the high pressure gas discharged from the compressor through line 15 exits the reverse flow port 34 and into the volume 54. The high pressure refrigerant in gaseous state passes through the screen 60 and into the outdoor heat exchanger 38 functioning as the system condenser. The oil entrained in the refrigerant gas will impinge on the screen 60 and be separated from the gaseous refrigerant and flow into the lower portion of the volume. This oil separated from the high pressure refrigerant gas is returned to the compressor oil sump 16 in a manner fully explained hereinafter. At the same time low pressure suction refrigerant gas exiting the indoor heat exchanger functioning as the system evaporator enters the upper end of volume 58 with the refrigerant gas entering the open outlet end 57 of standpipe 59 and flows through the reverse flow port 40 and returns to the compressor through the suction line 24. Liquid refrigerant present in the suction gas will fall to the bottom and metered to the compressor through metering hole 62.

Means are provided by the present invention to return the separated oil that is collected in the bottom portion of the volume to the compressor oil sump when the volume is subjected to the high pressure side of the system while preventing liquid refrigerant from flowing into the compressor sump when the volume is subjected to the low pressure side of the system. To this end, an oil return line or conduit 64, 66 is connected between the lower portion of each volume 54, 56, respectively, and the compressor oil sump 16. Pressure responsive flow valves 68, 70 are arranged in the line 64, 66 in a manner that insures flow theretrhough only when the volume it is connected to is subjected to the high pressure side of the system.

Figure 2:
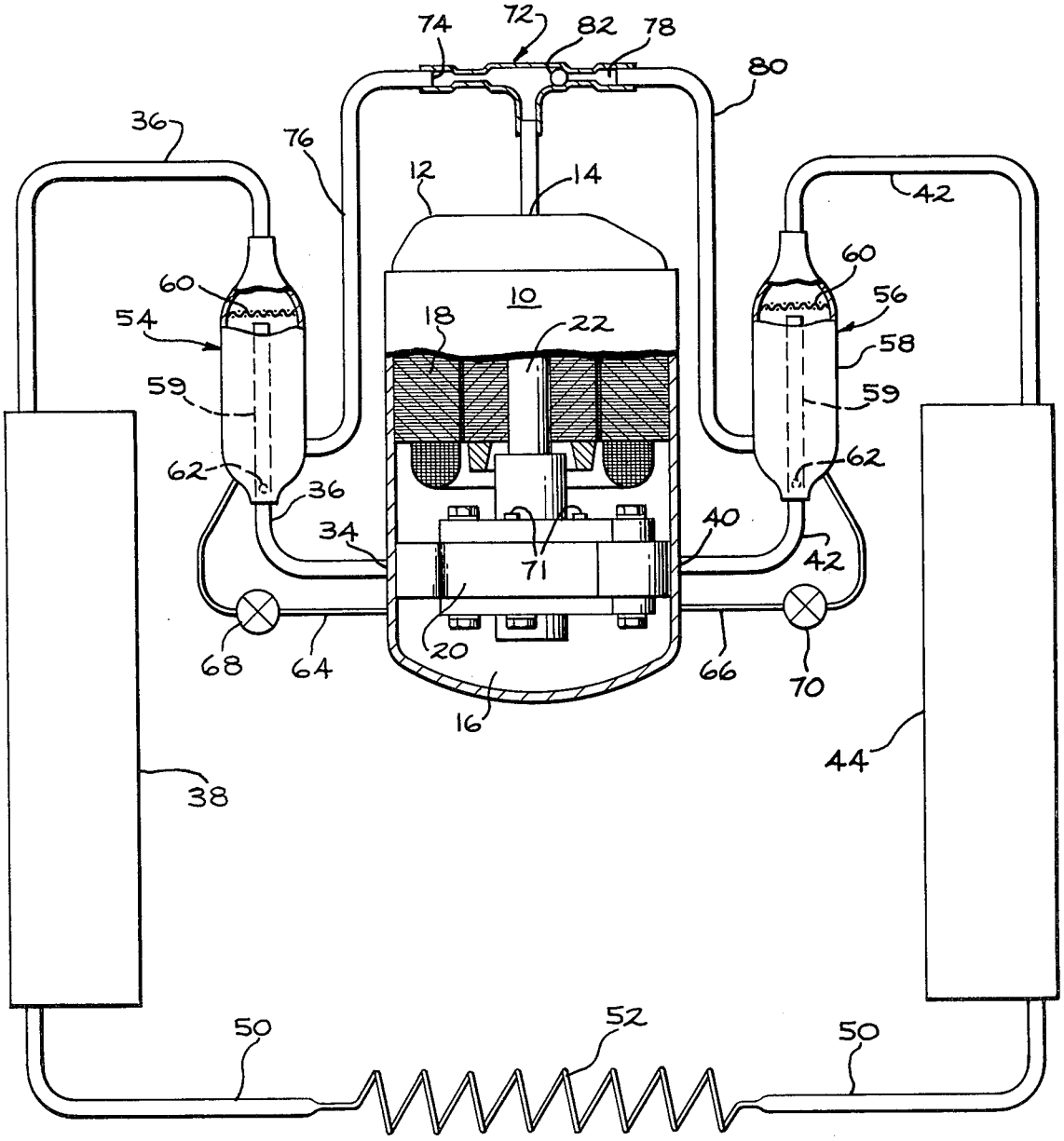
FIG. 2 is a schematic view of a reversible heat pump refrigeration system including another embodiment of the present invention.

Referring now to the embodiment shown in FIG. 2, there is shown a hermetically-sealed rotary compressor driven by a reversible electric motor. The motor 18 in this embodiment is electrically reversed and the reversing means is incorporated in the compressor. In this embodiment with the reversing valve arranged in the casing as an integral part of the compressor, refrigerant is directed between two ports 34 and 40 as an incident of motor rotation. In this type of compressor, the reverse flow ports 34 and 40 shown attached to the compressor function in precisely the same manner as ports 34 and 40 described in conjunction with the embodiment of FIG.1. For example, in the cooling cycle with the motor 18 rotating in one direction the high pressure refrigerant gas is discharged through the reverse flow port 34, with the low pressure suction gas returning to the compressor unit 20 through reverse flow port 40; while in the heating cycle with the motor 18 rotating in the other direction high pressure refrigerant gas is discharged through port 40 and low suction pressure suction gas is returned through port 34. As will be explained below, in this embodiment a portion of the refrigerant discharged from the compressor is directed into the casing and the discharge opening 14 serves to recirculate refrigerant gas that is discharged into the casing 12 for the purpose of cooling the motor 18. In describing this embodiment, all of the parts similar to those described relative to the embodiment of FIG. 1 are identified by the same reference numbers.

In this arrangement as mentioned above means are provided for cooling the motor 18 maintaining the interior of the casing 12 at high pressure. To this end, a discharge port 71 communicates with the interior of the casing. The exact manner in which the casing is maintained at high discharge pressure does not form a part of this invention and accordingly will not be described. It is only necessary that a portion of the high pressure discharge gas from the compressor be directed to the interior of the casing through discharge port 71 during operation of the compressor in either rotational direction. The discharge of a portion of the high pressure discharge gas from the compressor into the interior of the casing 12 may function in a manner similar to that shown and described in U.S. Pat. No. 4,367,638—Gray, and U.S. patent application No. S.N. 415,064—Ladusaw, filed Sept. 7, 1982, both being assigned to the General Electric Company, the assignee of the present invention which is hereby incorporated by reference.

Means are provided by this invention to cause that portion of refrigerant gas discharged into the casing 12 to recirculate through the system. To this end, a pressure responsive check valve 72 has its inlet connected to the compressor casing discharge opening 14. One port 74 of valve 72 is connected by a conduit 76 to volume 54 and the other port 78 of valve 72 is connected by a conduit 80 to volume 56. In the cooling cycle, volume 54 leading to outdoor heat exchanger 38 is at high discharge pressure with the volume 56 receiving refrigerant from indoor heat exchanger 44 at low suction pressure. In this mode of operation, the valve member 82 of valve 72 will move to close off conduit 80 to volume 56 and the high pressure gas from the casing 12 will enter volume 54 through conduit 76. Any entrained oil in the refrigerant gas will be separated in the manner described above and returned to the compressor oil sump through line 64. In the heating cycle, gas from the casing 12 will be directed to volume 56 through conduit 80 with the valve member 82 closing off conduit 76.

In both embodiments the function of the volumes 54 and 56 are identical. In summary, when a volume 54, 56 is at suction pressure liquid refrigerant will not drain into the sump through oil return lines 64, 66 because the compressor case being at high pressure will maintain the valve 68, 70 in its respective oil return line 64, 66 closed and, accordingly, the liquid refrigerant will meter back to the compressor through opening 62. When a volume is at discharge pressure, it functions as an effective oil separator as described above and because the volume is at this time at substantially the same pressure as the compressor casing, the valves 68, 70 will allow the oil collected in that volume to drain by gravity through its respective oil return line to the casing oil sump area.

It should be apparent to those skilled in the art that the embodiments described heretofore is considered to be the presently preferred form of this invention. In accordance with the Patent Statutes, changes may be made in the disclosed apparatus and the manner in which it is used without actually departing from the true spirit and scope of this invention.

What is claimed is:

1. A reversible refrigerant heat pump system including an indoor heat exchanger and an outdoor heat exchanger;

a hermetic casing having a discharge opening in its upper portion and an oil sump area in its lower portion;

a compressor unit positioned in said casing;

means connected between one end of said heat exchanger for expanding refrigerant from condenser pressure to evaporator pressure;

a fluid reversal means including first and second reverse flow ports for selectively connecting said compressor discharge opening to said indoor and outdoor heat exchangers, respectively, whereby said outdoor heat exchanger functions as an evaporator during operation of the unit in the heating cycle and said inside heat exchanger functions as an evaporator during operation of the unit in the cooling cycle;

a first conduit connecting the other end of said outdoor heat exchanger to said first reverse flow port of said fluid reversal means;

a second conduit connecting the other end of said indoor heat exchanger to said second reverse flow port of said fluid reversal means;

a volume connected in flow arrangement in each of said first and second conduits between said first and second reverse flow ports and said indoor and outdoor heat exchanger, respectively;

each of said volumes adapted to function as a suction accumulator when its associated heat exchanger functions as an evaporator and as a oil separator when its associated heat exchanger functions as a condenser;

said volumes each including a housing having top and bottom walls, said first and second conduits extending from the end connected to said fluid reversal means including a vertical portion extending through said bottom wall of said housing and terminating at an open inlet end adjacent said top wall of said housing, the other portion of said conduit extending from the end connected to said heat exchanger being connected to an opening in said top wall whereby said volume functions as a suction accumulator when refrigerant flow is from its associated heat exchanger during operation of the system is in one cycle and as an oil separator when refrigerant flow is from said compressor discharge opening during operation of the system is in the other cycle.

2. The reversible refrigerant heat pump system recited in claim 1 wherein said vertical portion in each of said volume includes an opening at the lower end thereof dimensioned for metering liquid refrigerant to said compressor when said volume is functioning as the system suction accumulator.

3. The reversible refrigerant heat pump system recited in claim 2 wherein a screen means is positioned in said volume between the open inlet end of said vertical portion and the opening in said top wall for causing oil entrained in discharge refrigerant gas to impinge thereon and separate from gaseous refrigerant when said volume functions as said oil separator.

4. The reversible refrigerant heat pump system recited in claim 2 wherein an oil return conduit including a one-way valve is connected between the compressor oil sump area and the lower portion of each of said volumes for returning said separated oil to said oil sump area when said volume is functioning as said oil separator.

5. The reversible refrigerant heat pump system recited in claim 1 wherein said compressor includes a discharge port and suction ports, said discharge port arranged for discharging high pressure refrigerant gas into said casing, a high pressure conduit is connected between said casing discharge opening and said fluid reversal means for delivering said high pressure refrigerant gas selectively to said first or second flow ports, and a low pressure conduit is connected between compressor unit and said fluid reversal for receiving low pressure suction refrigerant gas selectively from said heat exchangers through said first or second flow ports.

6. The reversible refrigerant heat pump system recited in claim 2 wherein said compressor unit is reversibly driven by a reversible motor and said fluid reversal means including said first and second reverse flow ports is arranged in said hermetic casing.

7. The reversible refrigerant heat pump system recited in claim 6 wherein said reversible compressor unit further includes a discharge means for discharging a portion of high pressure refrigerant gas into said casing during operation of said compressor unit in either rotatable direction.

8. The reversible refrigerant heat pump system recited in claim 7 wherein said vertical portion in each of said volumes includes an opening at the lower end thereof dimensioned for metering liquid refrigerant to said compressor when said volume is functioning as the system accumulator.

9. The reversible refrigerant heat pump system recited in claim 8 wherein a screen means is positioned in said volume between the open inlet end of said vertical portion and the opening in said top wall for causing oil entrained in discharge refrigerant gas to impinge thereon and separate from gaseous refrigerant when said volume functions as said oil separator.

10. The reversible refrigerant heat pump system recited in claim 9 wherein an oil return conduit including a one-way valve is connected between the compressor oil sump area and the lower portion of each of said volumes for returning said separated oil to said oil sump area when said volume is functioning as said oil separator.

11. The reversible refrigerant heat pump system recited in claim 10 wherein conduit means including a pressure responsive one-way valve connects said casing discharge opening to each of said volumes so that said portion of refrigerant discharge gas discharged into said casing flows from said casing to the volume functioning as said oil separator.

* * * * *